US009903128B2

(12) United States Patent
Lisk

(10) Patent No.: US 9,903,128 B2
(45) Date of Patent: Feb. 27, 2018

(54) SELF-CONTAINED SWIMMING POOL

(71) Applicant: Christopher David Lisk, Riverside, CA (US)

(72) Inventor: Christopher David Lisk, Riverside, CA (US)

( * ) Notice: Subject to any disclaimer, the term of this patent is extended or adjusted under 35 U.S.C. 154(b) by 0 days.

(21) Appl. No.: 15/094,848

(22) Filed: Apr. 8, 2016

(65) Prior Publication Data

US 2016/0298348 A1 Oct. 13, 2016

Related U.S. Application Data

(60) Provisional application No. 62/145,150, filed on Apr. 9, 2015.

(51) Int. Cl.
*E04H 4/00* (2006.01)
*E04H 4/14* (2006.01)

(52) U.S. Cl.
CPC ..... *E04H 4/0018* (2013.01); *E04H 4/144* (2013.01)

(58) Field of Classification Search
CPC ..... E04H 4/0018
See application file for complete search history.

(56) References Cited

U.S. PATENT DOCUMENTS 2,924,829 A * 2/1960 Mosier ..... E04H 1/12 296/176
3,648,300 A * 3/1972 Eisenberg ..... E04H 4/0037 4/494
5,367,719 A * 11/1994 Mermelstein ..... A63B 69/125 4/488
5,606,831 A * 3/1997 Tippmann ..... E04H 4/0043 220/678
7,984,519 B1 * 7/2011 Hall ..... E04H 4/005 4/507
2006/0064811 A1 * 3/2006 Midkiff ..... E04H 4/0018 4/496
2009/0176588 A1 * 7/2009 Lochtefeld ..... A63G 21/18 472/128
2016/0151695 A1 * 6/2016 Pacheco Moreira Amorim ..... A63B 69/12 4/489

FOREIGN PATENT DOCUMENTS

GB 2143126 A * 2/1985 ..... E04H 4/00

* cited by examiner

*Primary Examiner* — Janie Loeppke
(74) *Attorney, Agent, or Firm* — Chang & Hale LLP

(57) ABSTRACT

Swimming containers are disclosed including a first compartment at a first longitudinal end having a roof structure forming at least part of a deck structure, the first compartment having first and second doors providing access to the first compartment. A wall partition connected between the first and second sidewalls provides water-tight separation between the first compartment and a second compartment configured to hold a volume of water. A guide track runs along a longitudinal center of a bottom portion of the container, with first and second wheels disposed on opposite sides of the guide track, and a hook structure disposed at an end of the swimming container at least partially above the guide track.

18 Claims, 17 Drawing Sheets

SELF-CONTAINED SWIMMING POOL

RELATED APPLICATION

This application claims priority to U.S. Provisional Application No. 62/145,150, filed on Apr. 9, 2015, entitled SELF-CONTAINED SWIMMING POOL, the disclosure of which is hereby incorporated by reference in its entirety.

BACKGROUND

Field

The present disclosure generally relates to above-ground swimming pools.

Description of Related Art

Above-ground swimming pools are often cheaper and more convenient to install than in-ground pools. However, above-ground pools can be difficult to transport and install.

SUMMARY

In some implementations, the present disclosure relates to a swimming container comprising a first compartment at a first longitudinal end of the swimming container having a roof structure forming at least part of a deck structure, the first compartment having first and second doors providing access to the first compartment, a water pump housed within the first compartment, a water filter device housed within the first compartment, first and second sidewalls extending along a length of the swimming container, and a wall partition connected between the first and second sidewalls at a position along the length of the swimming container, the wall partition providing water-tight separation between the first compartment and a second compartment configured to hold a volume of water. The swimming container further comprises a bottom portion comprising one or more drain apertures, a guide track that runs along a longitudinal center of the bottom portion, first and second wheels disposed on opposite sides of the guide track at a second longitudinal end of the swimming container, and a hook structure disposed at the second longitudinal end of the swimming container at least partially above the guide track.

In certain embodiments, at least one of the first and second doors comprises a vent aperture. The swimming container further comprises a pipe running beneath the bottom portion and connecting the one or more drain apertures to the water pump in the first compartment. In certain embodiments, the first sidewall includes a window comprising a rigid, transparent panel structure.

The deck may be configured to provide an ingress/egress platform for the second compartment. The swimming container may further comprise one or more removable exterior panels secured to one or more of the first and second sidewalls. The swimming container may further comprise a support beam extending vertically along each of the first and second sidewalls and below the bottom portion to provide support for the swimming container. The support beam may be integrated with a window frame of the first sidewall.

In certain embodiments, the bottom portion further comprises support members at each of four corners of the container. For example, the support members may comprise two wheel supports and two foot supports. In certain embodiments, the swimming container further comprises a rectangular upper frame at least partially lining an upper perimeter of the second compartment, the upper frame including a receptacle configured to removably receive a connection portion of a recessed platform structure. For example, the recessed platform structure may form a shallow-end standing surface for the second compartment when secured to the upper frame. Alternatively, the recessed platform structure may form a seat disposed within the second compartment when secured to the upper frame. The swimming container may further comprise a radiused floor surface forming a longitudinal cavity between the radiused floor surface and the bottom portion. In certain embodiments, a pipe is disposed within the longitudinal cavity that is connected to the water filter device.

In some implementations, the present disclosure relates to a method of manufacturing a swimming container. The method may involve providing an open-top container having a rectangular prism shape. For example, the container may include a front end wall, first and second sidewalls, a back end wall formed of first and second doors, and a bottom structure comprising a guide track that runs along a longitudinal center of the bottom structure, first and second wheels secured on opposite sides of the guide track, and a hook structure disposed proximate the front end wall at least partially above the guide track, the front end wall, the first and second sidewalls, the back end wall, and the bottom structure forming a trench. The method may further involve dividing the trench into a first compartment and a second compartment at least in part by attaching a wall partition to the first and second sidewalls in a substantially water-tight attachment, forming a deck structure at least in part by attaching a roof structure to the first and second sidewalls, the back end wall, and the wall partition at least partially above the first compartment, disposing a water pump and a water filter within the first compartment, forming an aperture in the second compartment, and connecting the water pump to the aperture.

In certain embodiments, the method further involves cutting a vent aperture in the first door. The method may further involve forming a receptacle in an frame lining at least part of the second compartment, the receptacle being configured to removably receive a connection portion of a recessed platform structure. For example, the recessed platform structure may form a shallow-end standing surface for the second compartment when secured to the upper frame. Alternatively, the recessed platform structure may form a seat disposed within the second compartment when secured to the upper frame.

BRIEF DESCRIPTION OF THE DRAWINGS

Various embodiments are depicted in the accompanying drawings for illustrative purposes, and should in no way be interpreted as limiting the scope of the inventions. In addition, various features of different disclosed embodiments can be combined to form additional embodiments, which are part of this disclosure. Throughout the drawings, reference numbers may be reused to indicate correspondence between reference elements.

DETAILED DESCRIPTION

While certain embodiments are described, these embodiments are presented by way of example only, and are not intended to limit the scope of protection. Indeed, the novel methods and systems described herein may be embodied in a variety of other forms. Furthermore, various omissions, substitutions and changes in the form of the methods and systems described herein may be made without departing from the scope of protection.

The headings provided herein are for convenience only and do not necessarily affect the scope or meaning of the claimed invention. Disclosed herein are example configurations and embodiments relating to above-ground swimming containers.

Swimming Container Assembly

Figure 1:
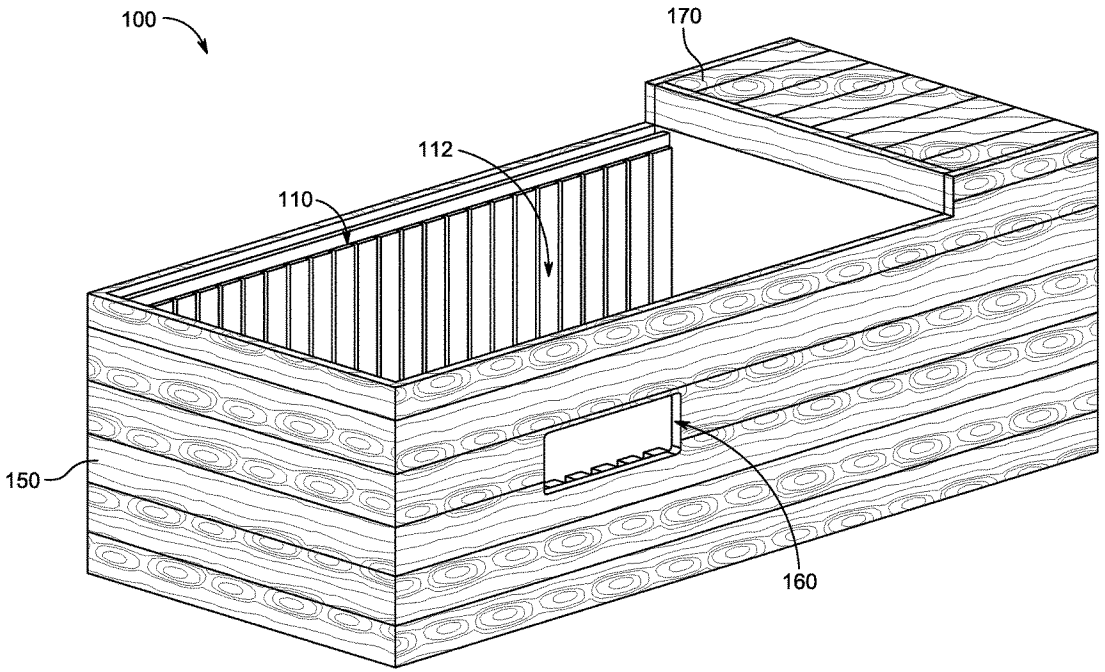
FIG. 1 is a perspective view of a swimming container in accordance with one or more embodiments disclosed herein.

FIG. 1 is a perspective view of a swimming container 100 in accordance with one or more embodiments disclosed herein. In certain embodiment, as illustrated, the swimming container, or at least a portion thereof, may have a substantially rectangular prism-like shape. The swimming container 100 may comprise an inner container structure 110 configured to form an inner chamber designed and proportioned to hold a volume of water for swimming therein, or for other purposes. The swimming container 100 may further comprise an exterior surfacing or structure 150 that may serve to provide additional support, structure, and/or aesthetic features for the swimming container 100.

The swimming container 100 may further comprise a deck or platform 170, which may provide support for standing thereon, or for other purposes. In certain embodiments, the deck 170 is designed to lie above a portion of the swimming container 100 configured to house one or more pool components, such as one or more skimmers, pumps, filters, or other machinery or devices that provide functionality for operating the pool 100. The deck 170 may provide at least partial protection for pool components, or other components of the swimming container 100 against, for example, inclement weather, debris, or other potential hazards. The deck 170 may provide sufficient support or strength to support the weight of multiple individuals simultaneously, and may serve as a point of ingress and/or egress with respect to the water chamber 112.

The interior structure 110 and/or exterior structure 150 may include one or more apertures or transparent portions which may provide a window 160 whereby water within the chamber 112 may be viewable from an exterior perspective. In certain embodiments, the window 160 may comprise an acrylic or other rigid, at least partially transparent, window panel structure, which may allow for the container to hold water within the water chamber 112 at a vertical level above at least a portion of the window 160. Although the window feature 160 illustrated in FIG. 1 details a substantially rectangular shaped window, it should be understood that swimming containers according to embodiments disclosed herein may include any number, size or shape of window features. Furthermore, although the window feature 160 is illustrated on a first side portion or panel of the swimming container 100, window features may be present on either or both sides of a four-sided swimming container like that shown in FIG. 1.

The exterior structure or surface 150 may comprise wood or other type of paneling which may provide structural support and/or aesthetic features which may be desirable as adding to the decorative quality of the swimming container 100. Any type of material or shape or configuration of pieces or structures may be utilized to construct the exterior surface 150, such as new or reclaimed wood, plywood, plastic, vinyl, or the like, each of which may have various uses and/or benefits vis-à-vis other possible options. In certain embodiments, the exterior paneling or surface 150 may be removable or reconfigurable, based on various considerations, such design considerations or the like.

Between the interior structure 110 and the exterior structure 150, a cavity may exist which may be filled with, for example, insulation or other material. Insulation disposed between the two layers may advantageously improve efficiency with respect to temperature conditioning of water within the water chamber 112. For example, when it is desirable for water to have a temperature that differs to some degree from the environmental temperature outside of the swimming container 100, such as for purposes of providing comfort to users of the swimming container, the insulation may reduce the surface area through which at least some of the thermal energy in the container water may transfer out of and into the water housed in the water chamber 112.

Although not illustrated in FIG. 1, the swimming container 100 of FIG. 1 may have associated therewith, or integrated into the structure thereof, one or more stair and/or latter features to aid in the ingress and/or egress to and/or from the pool chamber 112 by users thereof.

Figure 2:
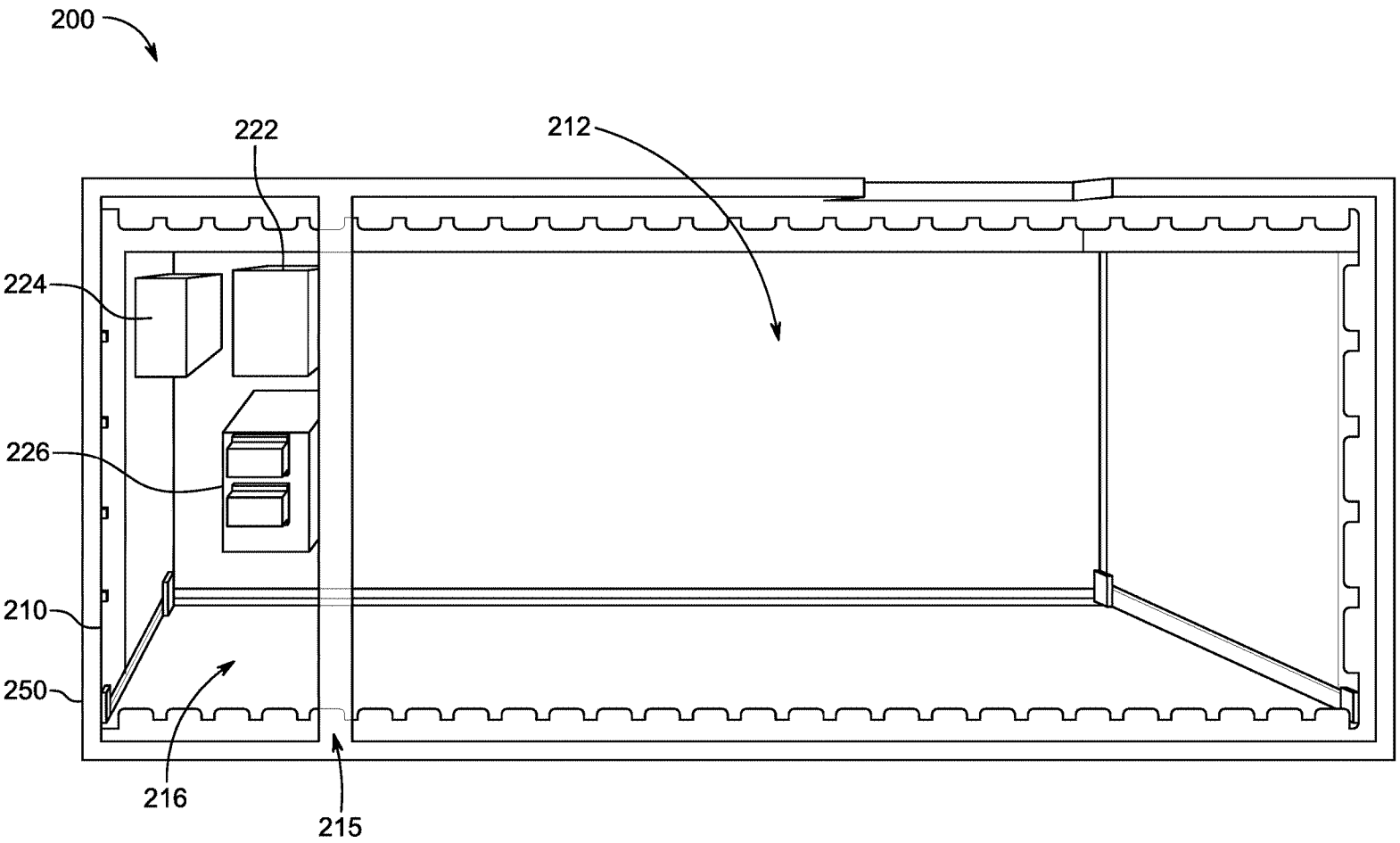
FIG. 2 is a cross-sectional side view of a swimming container according to one or more embodiments.

FIG. 2 is a cross-sectional side view of the swimming container 200, which may be similar in certain respects to the swimming container 100 of FIG. 1 described above. The swimming container 200 of FIG. 2 includes an interior container 210, as well as an exterior covering or surface 250. In certain embodiments, as shown, the interior container 210 may comprise a plurality of partitioned areas or chambers, such as the illustrated swimming chamber 212, as well as the component housing chamber 216. The two separate chambers 212, 216 may be divided by at least one partition structure 215, which may be a vertical wall panel disposed between the two chambers 212, 216. As it may be desirable for the swimming chamber 212 to hold a volume of water for swimming, the partition 215 may advantageously be secured and/or positioned with respect to the interior container 210 such that it is water-tight, thereby preventing water contained within the swimming chamber 212 from flowing into the pool component housing chamber 216. Due to the mechanical and/or electrical features of the various pool components housed within the pool component housing 216, it may be desirable to prevent, or at least reduce the effects and/or risk of substantial amounts of water flowing freely within the housing chamber 216.

The swimming chamber 212 may be referred to herein as a primary or main compartment of the swimming container 200. In certain embodiments, the interior chamber 210 is constructed from a dumpster container structure. It may be desirable for such a structure to be treated in a manner as to improve the water-holding characteristics of the container, at least with respect to the swimming chamber 212. Therefore, the various corners, creases, seems, and/or other features of the interior container 210, particularly of the swimming chamber 212, may comprise water-tight welds, water-proof panes/panels or other surfaces or materials in order to improve the ability of the container to hold large volumes of water therein.

The swimming chamber 212 may be used primarily as a water housing, wherein users may swim for recreational, therapeutic, or other purposes in the swimming chamber 212 when a volume of water is contained therein. In order to facilitate the use of the swimming chamber 212 for swimming purposes, it may be desirable for swimming components, such as one or more pumps, filters, skimmers, jets, or the like, to function in connection with the swimming chamber 212 for the purpose of cleaning, heating, or otherwise treating the water housed in the swimming chamber 212. Therefore, one or more jet intake and/or outtake channels may lead between the swimming chamber 212 and the pool component housing chamber 216, or other exterior chamber or area.

The pool components housing chamber 216, which may be referred to herein as a secondary compartment of the swimming container 200, may house one or more machines or devices configured to provide pool maintenance system functionality for the swimming container 200. In particular, the secondary chamber 216 may include one or more water and/or air pump devices 226, water filtration, or treatment devices 224, water heating components 222, and/or other components. The pump system 226 may be designed to accommodate the water volume capacity of the swimming chamber 212 with regard to workload capability. The filtration system 224 may be any desirable filtration system, such as reverse osmosis filter, sand filter system, cartridge filter system, diatomaceous earth (D. E.) filter, or other type of filter system. Although the swimming container 200 is illustrated as including a heating system 222, in certain embodiments, the pool container is not equipped with water heating capability.

The partition structure 215 may comprise a steel panel welded to one or more portions of the interior wall of the interior container 210. For example, the partition 215 may be welded or secured on three sides to the interior of the interior container 210, such as on a first side, a bottom side, and a second side. In certain embodiments, the partition 215 is removable and/or repositionable. For example, in certain embodiments it may be possible to remove the partition 215 at least in part by sliding the panel upward or in a forward or backward direction in order to modify the volume of the chamber 212 with respect to that of the chamber 216.

In certain embodiments, one or more door structures may be positioned adjacent to the component housing chamber 216 to thereby allow access to the chamber. Access to the housing chamber 216 may be advantageous for the purpose of manipulating and/or operating components disposed therein. In certain embodiments, the pool components housing chamber 216 houses an electrical system (not shown), which may be used to provide electrical power to one or more components of the pool container 200. In certain embodiments, the electrical subsystem may be powered via a cable that extends externally from the pool container 200, and may be plugged in to a power source external to the pool container 200.

Figure 3:
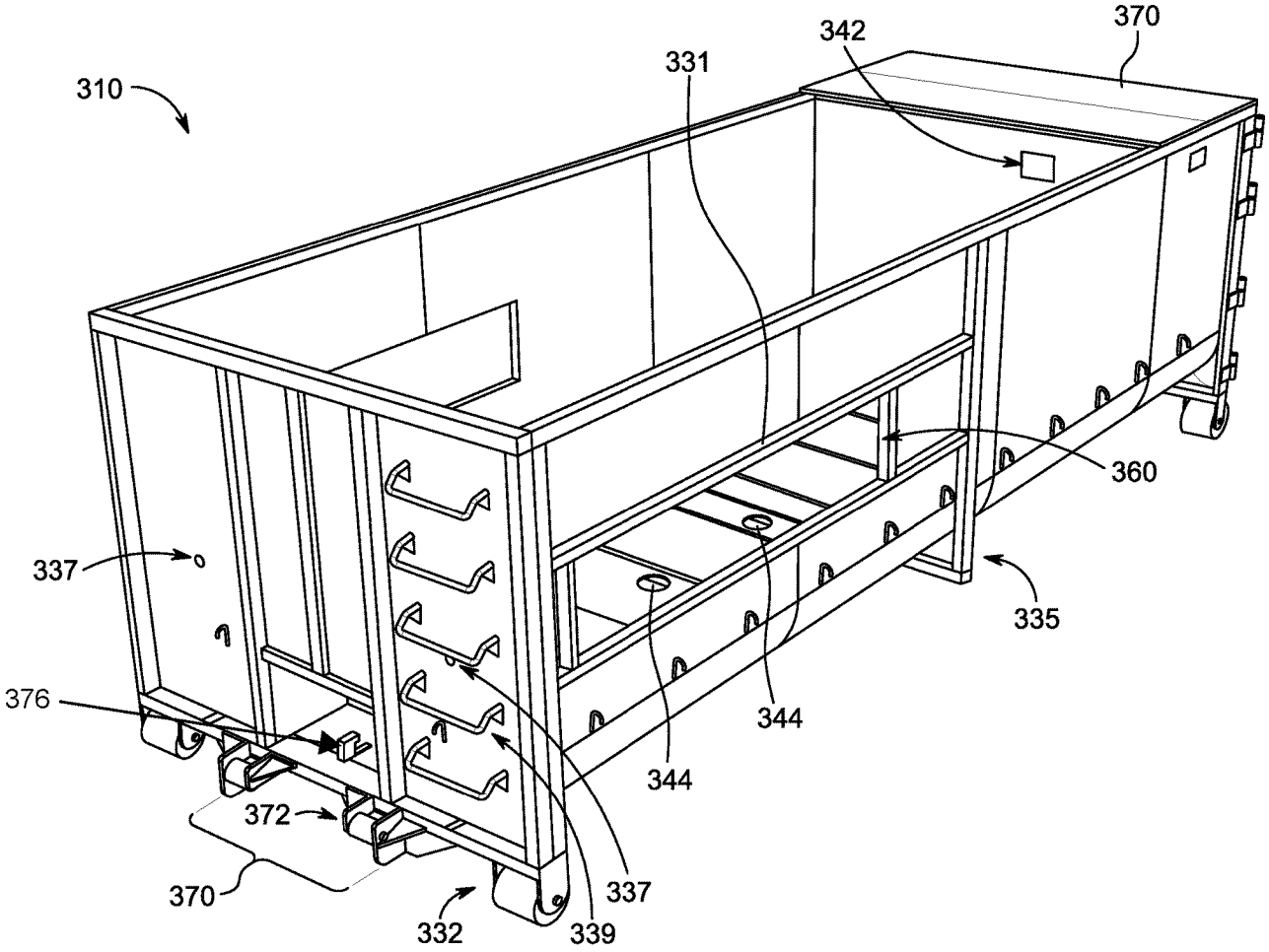
FIG. 3 illustrates a perspective view showing front and side portions of an interior container for a pool container assembly according to one or more embodiments.

FIG. 3 illustrates a perspective view showing a front and side portions of an interior container 310 for a pool container assembly. In certain embodiments, the container 310 is a role-off container comprising one or more wheels 332 as well as a track system 370, which may extend along a longitudinal axis of the container 310, such as along the bottom portion of the container, as shown.

The container 310 may be an open-top dumpster having a substantially-rectangular footprint. The container 310 may utilize one or more wheels 332 to facilitate rolling of the container 310 into a desired position. The container 310 may be designed to be transported by a roll-off truck. The container 310 may include one or more swinging doors (not shown) on a back end of the container to provide access to a secondary chamber of the container 310.

The container 310 may have a rectangular footprint conforming to the size of a roll-off truck designed to transport containers having at least some of the physical characteristics of the container 310. The shape, features and configuration of the container 310 may therefore allow for portability of the swimming container 310, which may provide advantages over other swimming structures that may not be loaded onto standard roll-off trucks for transportation thereof. The weight of the container 310 may be such as to meet compliance standards with road-use and safety laws and regulations.

The container 310 may be designed and configured to be transported and placed by a roll-off truck, wherein such tasks may be performed at least in part by using a cable and winch system, or a hook-lift system. The container 310 may have one or more features which may allow for securing a hook or cable thereto for the purpose of loading the container to a truck and/or securing the container to the truck during transport. To unload the container 310, the truck may raise a hydraulically-operated bed component/member to allow the one or more wheels (e.g., 332 and/or 372), in combination with gravity and/or other features of the container, to cause the container 310 to roll-off of the bed of the truck onto a landing surface, wherein the container is maintained in a substantially straight alignment using 370 of the roll-off assembly associated with the bottom portion of the container 310. In certain embodiments, the container may be configured to be secured to a cable that may assist in slowly lowering the container 310 onto the landing surface. For example, the container 310 may include a hook or other attachment member 376 (e.g., ring, loop, or the like) for securing a cable to the container 310. The hook 376 may therefore be disposed at or toward a front side or portion of the container, as shown.

The track system 370 of the container 310 may help guide the container in loading or unloading from a truck or other machinery, and may provide support for the container when secured to a truck or the like. The track 570 may run along a longitudinal center of the container 310. The container 310 may comprise additional support members which may provide support for the container 310 during transit as well as while stationary in a landing position. For example, the container 310 may include one or more support beams or bars, such as the support beam 335 shown. Although only a single support beam is shown, certain embodiments may comprise a plurality of support beams, which may be physical structures integrated with the container 310 along longitudinal positions of the body of the container. The support member 335 may extend from the body of the container to contact a surface, such as the ground, when the container is in a resting position The container 310 further comprises one or more support members disposed at corner regions of the container, or other regions. Although the container 310 shows wheel support members (e.g., 332) at each of the viewable bottom corners of the container, in certain embodiments, one or more of the corner/bottom support structures may comprise foot members or other support structures, and need not comprise wheels. The collective support features of the container 310 may be configured to support the weight of the container, as well as the weight of any components and/or water contained therein. For example, in certain embodiments, the container 310 is configured to support the weight of up to 50,000 pounds, or more, a large portion of which may be attributable to a volume of water contained within the swimming chamber of the container.

The container 310 may include one or more exterior ladder rungs 339, which may provide convenience and/or safety functionality for users getting in and/or out of the pool chamber. The container 310 may further comprise water jet intake ports 337 for feeding water for circulation purposes into the interior of the swimming chamber. In certain embodiments, the intake ports 337, together with one or more drain ports 344, create a cleaning cycle for circulating and/or cleaning water in the swimming chamber. Furthermore, the swimming container 310 may comprise a skimmer port 342 at, for example, a wall of the swimming chamber, which may be configured to pull water from the swimming chamber for cleaning, a heating, circulation or other purposes. The various circulation ports (337, 344, 342) may each be configured to expel and/or suck water into or from the swimming chamber of the swimming containing 310. Although the various ports are illustrated in certain portions or regions of the swimming container 310, it should be understood that such ports may have any desirable or practical positioning and/or configuration.

The support beam structure 335 may be adjacent to or integrated with a window support structure 331. The window support structure 331 may provide a frame around the window 360. In certain embodiments, the window support structure 331 includes tab structures (not shown) around the window frame, which may be shaped and configured to nestingly receive an acrylic or other type of windowpane and provide support thereto. In certain embodiments, the tab structures of the window support structure 331 may be approximately 1 to 2 inches in thickness. The tabs structures may provide a stub frame structure that the windowpane may be nested in, wherein the water pressure inside the swimming chamber may provide outward force pressing the windowpane against the window support structure 331, thereby at least partially securing the windowpane in place. The windowpane may be further secured to the swimming container 310 with an adhesive or seal or other type of securing substance or structure.

Figure 4:
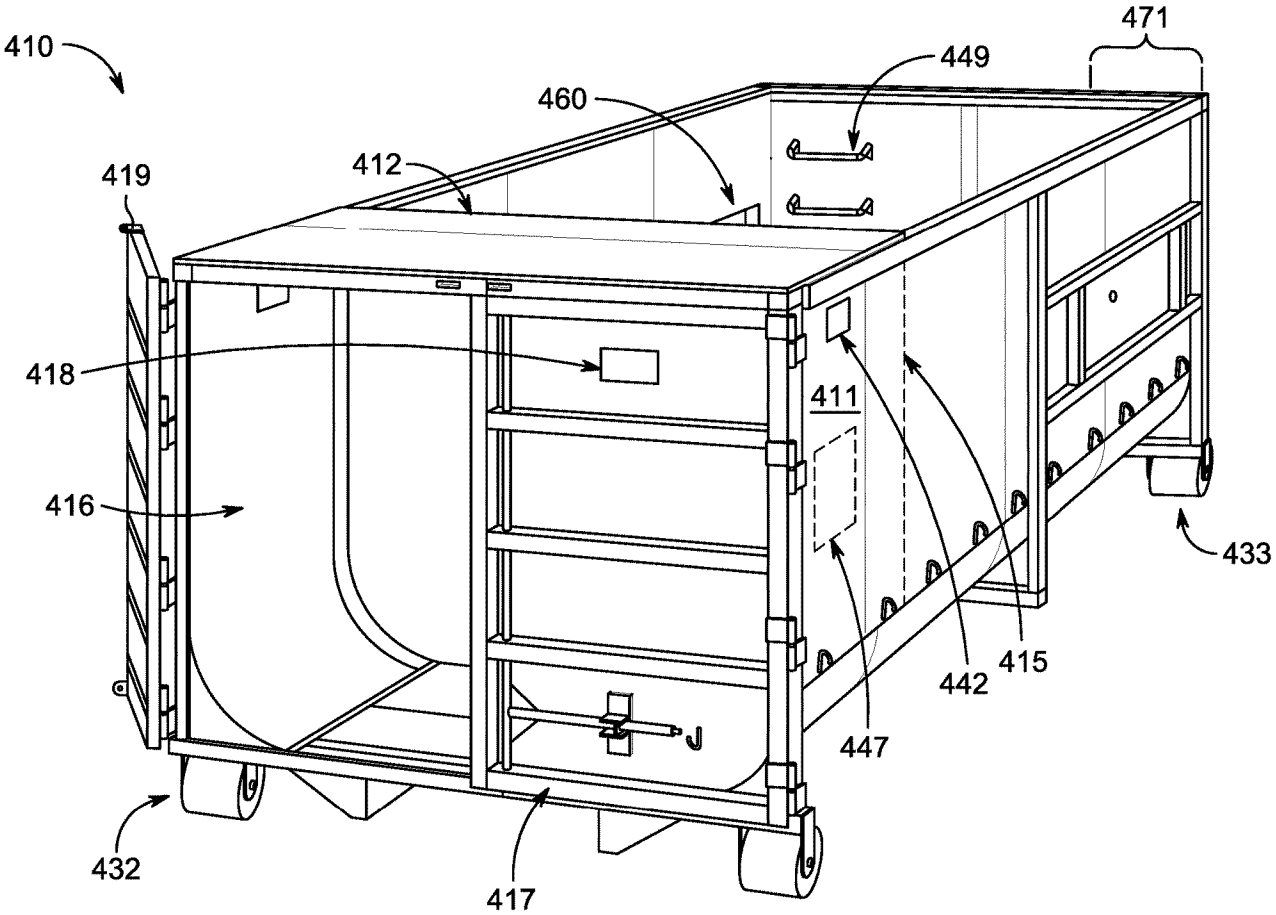
FIG. 4 is a perspective view showing back and side portions of a swimming container according to one or more embodiments.

FIG. 4 is a perspective view showing back and side portions of a swimming container 410, which may correspond to the swimming container 310 shown in FIG. 3 and described above. Swimming container 410 includes an internal swimming chamber configured to hold a volume of water, as described above. Within the swimming chamber, the container 410 may comprise one or more internal ladder rungs 449, which may be provided for convenience and/or safety purposes for allowing users to support themselves within the swimming chamber, as well as climb out of the swimming chamber.

On the back side of the container 410, a pool supply housing compartment 416 may be accessible through one or more door members 417, 419. As illustrated, the door 417 is in a substantially closed position, whereas the door 419 is in an open position. The pool component housing compartment 416 may be configured with one or more ventilation apertures or holes 418, 442, which may provide ventilation for one or more components, such as heating and/or cooling components and the like. The various ventilation apertures may be positioned on any outward facing wall or structure of the housing compartment 416, such as in one or more of the door structures or side wall structures, such as the sidewall portion 411 of the side of the swimming container 410. In certain embodiments, the sidewall portion 411 of the housing compartment 416 may be fitted with an electrical box or electrical plug or access feature. For example, as certain components housed within the housing 416 may consume electrical power, such electrical power may be sourced from an external outlet or power source, and may be provided to the components in the housing through an electrical access accessible through the sidewall 411. In certain embodiments, an electrical box is disposed within the housing 416 and electrically coupled to a cable or electrical port secured to the sidewall 411, or running therethrough. In certain embodiments, the electrical box may be configured to be coupled to a 220 V electrical outlet. In certain embodiments, the electrical access (not shown) of the sidewall 411 simply consists of an aperture through which an electrical cable may run.

An upper frame 471 of the swimming container 410 may include one or more ridge or recess features, or receptacles, configured to receive and/or secure components thereto (e.g., in a configuration allowing for attachment and removal of the component(s)), wherein certain add-on components may be secured to the upper frame 471 to provide additional features not shown in the figure. For example, such add-on features may include seating structures, platform structures, or the like. In certain embodiments, a shallow end may be provided for the swimming container 410 by securing a platform structure to the upper frame 471 at one or more sides or regions thereof. Such components may have hook or latch features configured to secure to corresponding recess or mounting structures of the upper frame 471 and thereby be mounted or secured thereto.

The swimming container 410 may further include one or more wheels 432 and/or one or more feet or other support structures, as described above. Furthermore, the swimming container 410 may comprise a track system for being fitted to a roll-off truck or the like, or one or more other components described in connection with one or more other components or embodiments disclosed herein.

Figure 5:
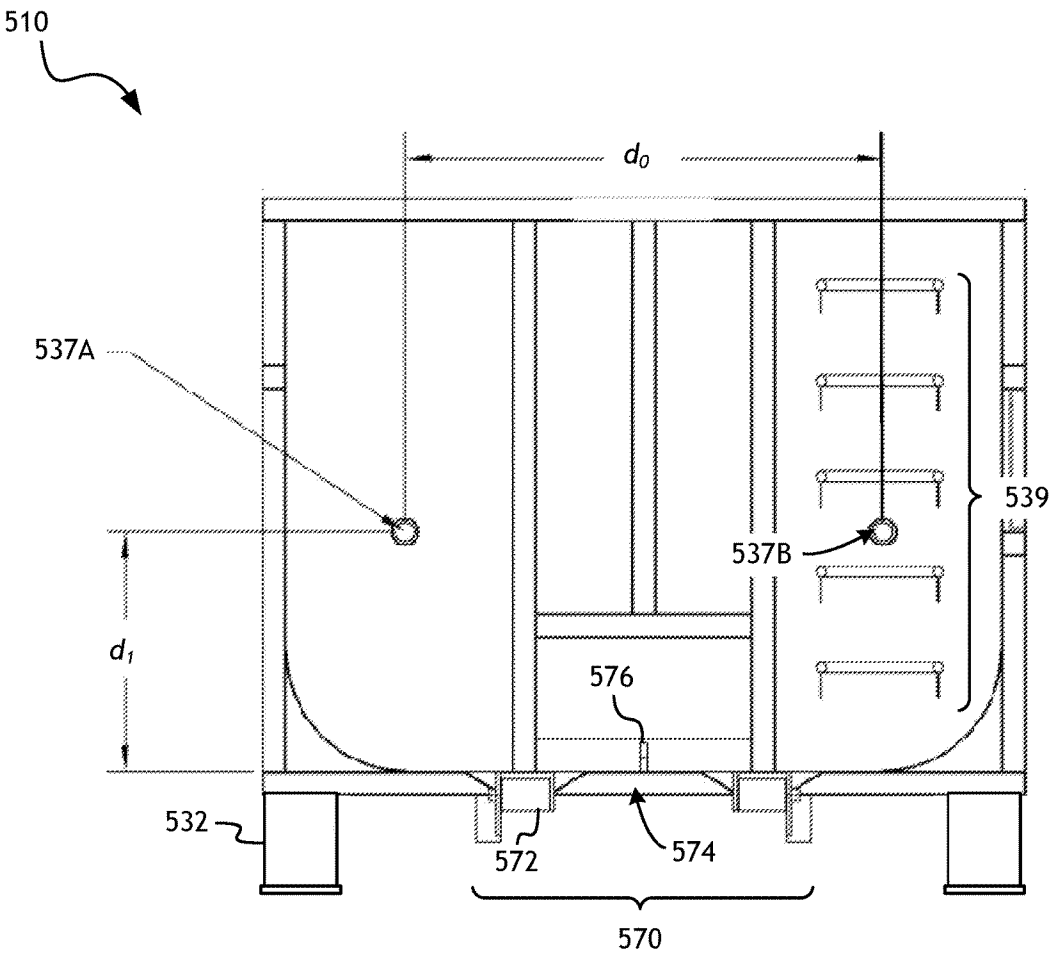
FIG. 5 illustrates a front view of a swimming container according to one or more embodiments.

FIG. 5 illustrates a front view of a swimming container 510. The illustrated embodiment FIG. 5 may include one or more features disclosed in connection with FIG. 3 and/or FIG. 4. For example, the swimming container 510 may include one or more feet structures 532, or wheel structures, which may provide supports for the swimming container.

The container 510 may further comprise a track system 570 including one or more wheel structures 572, as well as a guide region 574. The container 510 may further comprise a hook or locking member 576 for securing the container to a truck or other structure.

The container may include one or more push jet apertures 537A, 537B, which may be positioned a distance $d_0$ apart, and may be positioned a distance $d_1$ vertically from a bottom of an internal swimming chamber of the container 510. The push jet features may be used for filtration purposes or the like, as described above. The front portion of the container 510 may further comprise one or more ladder rungs 539 for providing functionality for entry into the swimming chamber of the container 510, or support for the user to secure his or herself to the exterior of the container 510.

Figure 6:
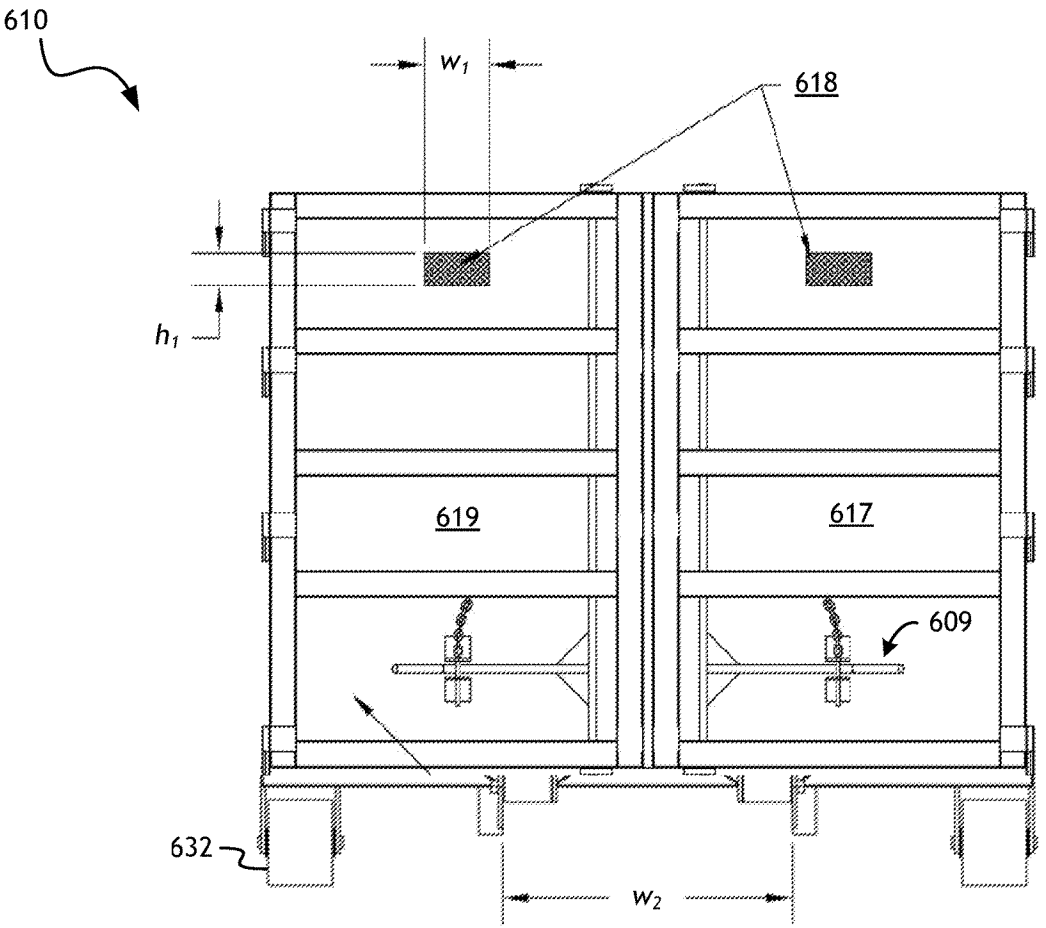
FIG. 6 is a back view of a swimming container according to one or more embodiments.

FIG. 6 is a back view of a swimming container 610. The swimming container 610 includes one or more doors 619, 617, which may be configured to provide access to a pool component housing compartment or chamber, such as that described above. One or more of the door members may comprise a locking or securing feature 609, such as a locking lever system, configured to lock or secure the respective door in a closed position. One or more of the door members may further comprise a vent access or aperture 618, which may have any desirable or practical dimensions. For example, a door vent may have a width $w_1$, which may be, for example, approximately 24 inches, and a height $h_1$, which may be, for example, approximately 12 inches. The one or more door vents may provide venting for electrical and/or mechanical components housed within the component housing chamber position behind the door members 619, 617.

The swimming container 610 may further comprise one or more wheel or other support structures 632 at a back end of the container. Furthermore, the container 610 may comprise a track system on an underside of the container. In certain embodiments, the track system may have a width $w_2$, such as, for example, a width of approximately 24 inches.

Figure 7:
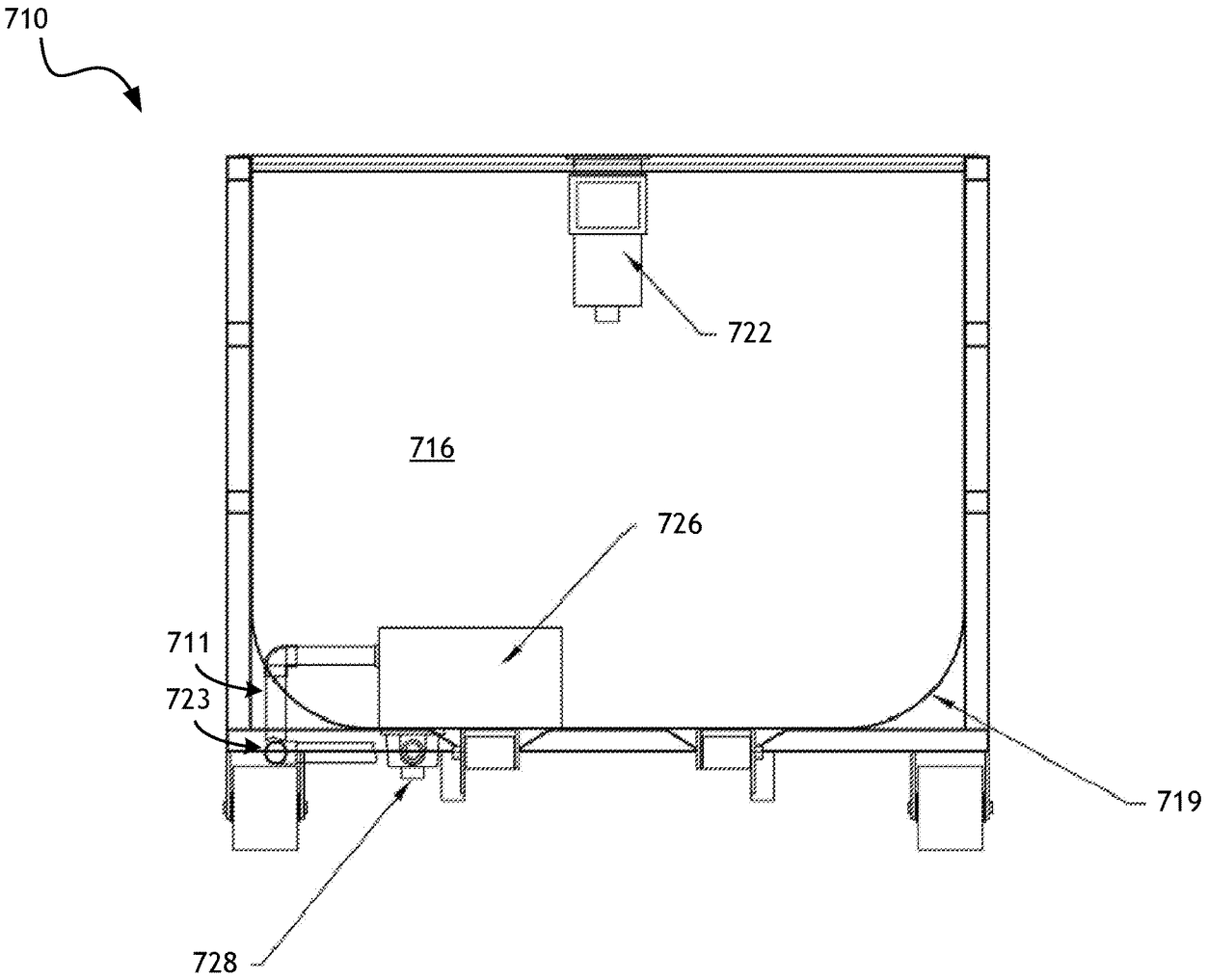
FIG. 7 provides a cross-sectional view of a swimming container according to one or more embodiments.

FIG. 7 provides a cross-sectional view of the swimming container 710, which may be similar in certain respects to the container 610 shown in FIG. 6 and described above. The view of FIG. 7 may represent a view of the container 610 of FIG. 6 providing a view of the component housing chamber 716 positioned behind the door members 619, 617 of the container 610.

The container 710 includes a skimmer component 722, which may comprise a pump and/or drain component positioned to receive water through a duct or aperture leading through a retaining wall of the swimming container 710 and into a swimming chamber positioned opposite the retaining wall, and possibly holding a volume of water therein. The container 710 further includes one or more additional pump and/or filtration components 726, which may be connected to certain plumbing structures providing plumbing routing for pool components.

In certain embodiments, the swimming chamber and/or other portions of the swimming container 710 may be a substantially radiused container in one or more regions. For example, while the interior of the pool component housing chamber may be substantially cubicle in shape, a bottom portion of the swimming chamber may include a rounded corner 719, wherein a cavity 711 between the rounded/radiused corner of the pool chamber and he write-angle corner of the container 710 may be utilized for the purpose of providing feeding/channeling plumbing components at least partially therein. For example, as shown, one or more pipes 723 may be configured to run through the cavity 711 along a longitudinal direction of the container 710 to provide water circulation to other more remote portions of the container 710. In certain embodiments, plumbing pipes are configured to run through the cavity 711 to one or more drain components 728 that may be disposed, for example, on an underside of the swimming chamber (not shown) of the container 710.

Figure 8A:
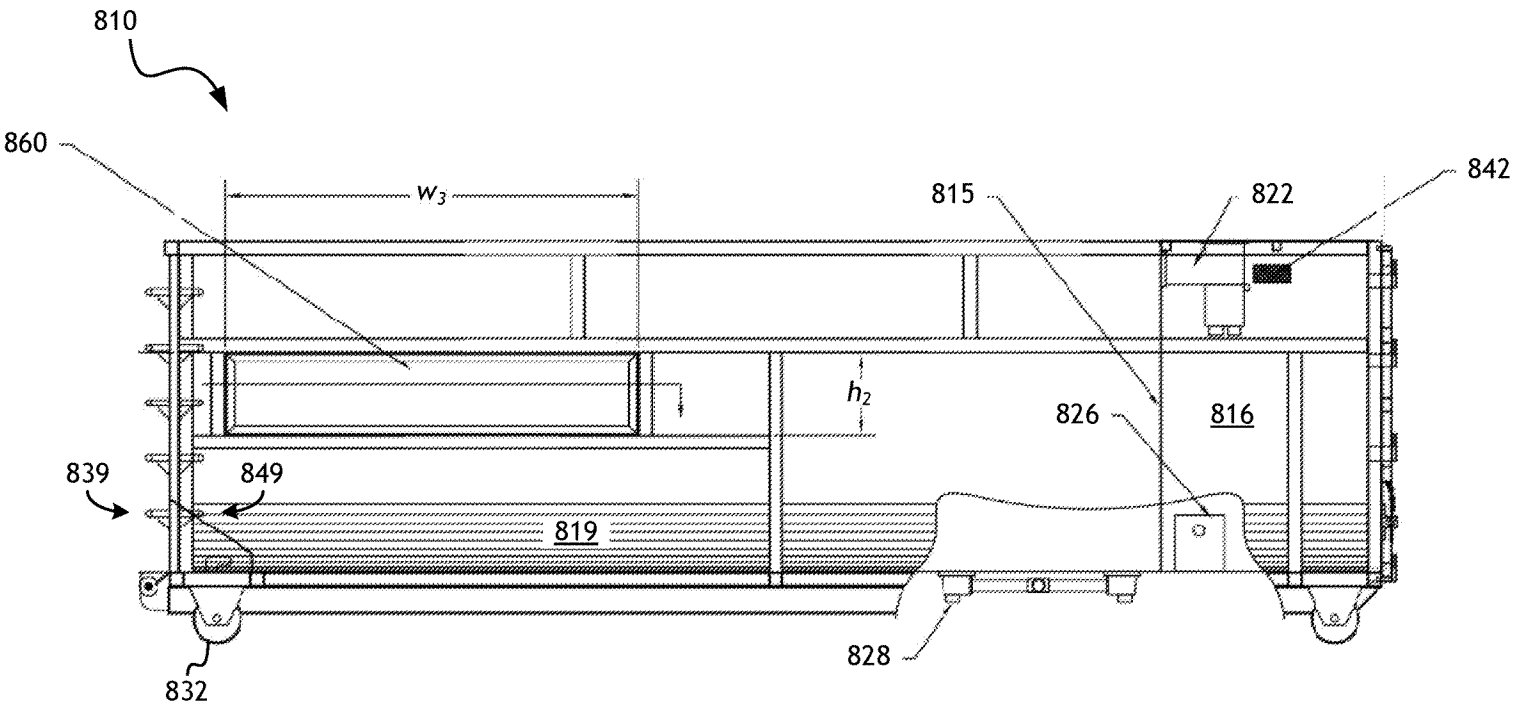
FIG. 8A shows a side view of a swimming container according to one or more embodiments.

FIG. 8A shows a side view of a swimming container 810, which may be similar in certain respects to the swimming container 710 shown in FIG. 7 and described above. The swimming container 810 includes a window 860, which may have a width $w_3$ of approximately 90 inches and a height $h_2$ of approximately 18 inches, for example. The window 860 may provide a view into a swimming chamber of the swimming container 810.

The swimming container 810 may further comprise one or more internal ladder rungs 849, as well as external ladder rungs 839, which may provide functional and/or safety features for the swimming container. The diagram of FIG. 8 a provides a view of a radiused bottom corner 819 of the swimming chamber of the container 810, which may run along a longitudinal axis of the container 810 for at least a portion of the length of the container. As described in reference to FIG. 7, in certain embodiments, pool plumbing components may be run outside of the radiused corner of the swimming chamber to provide access to one or more drain features 828 by pool components housed in a housing chamber 816 of the swimming container 810, such as a pump 826 and/or skimmer 822, as well as other components possibly. Although the drain components 828 are illustrated as being positioned in proximity to the pump 826 or other components housed in the housing 816, it should be understood that drain features 828 may be positioned at any point along the width or length of the underside of the swimming container 810.

Figure 8B:
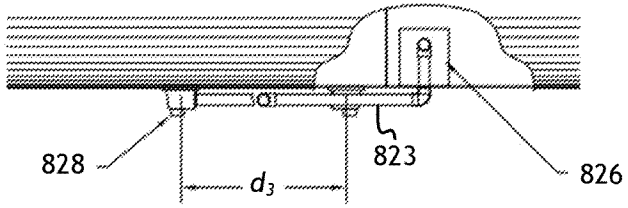
FIG. 8B provides a close-up view of certain components illustrated in the diagram of FIG. 8A according to one or more embodiments.

FIG. 8B provides a close-up view of certain components illustrated in the diagram of FIG. 8A. For example, the figure shows the pump 826 connected to plumbing components 823 that run between the pump 826 and one or more drain components 828. In certain embodiments, a swimming container has a plurality of drain components disposed on an underside of the swimming chamber of the container a distance $d_3$ apart, such as a distance of approximately 22 feet. In certain embodiments, the distance $d_3$ may be approximately 36 inches, or other distance. The distance between drain components may be selected to provide compliance with relevant regulations or specifications. The plumbing components 823, which may comprise one or more pipes or tubes for channeling water between the pump 826 and the one or more drains 828 may run on an underside of the container 810, or may be disposed at least partially within a cavity between a radiused corner of the swimming chamber of the swimming container and an outer right-angle-corner, wherein a cavity comprises the space therebetween.

The plumbing 823 may run along the radiused corner 819 to one or more jets (not shown), which may be, for example, intake jets. In certain embodiments, the intake jets are connected to plumbing lines which connect between the intake jets and one or more of the drains 828 and the pump 826.

Figure 9A:
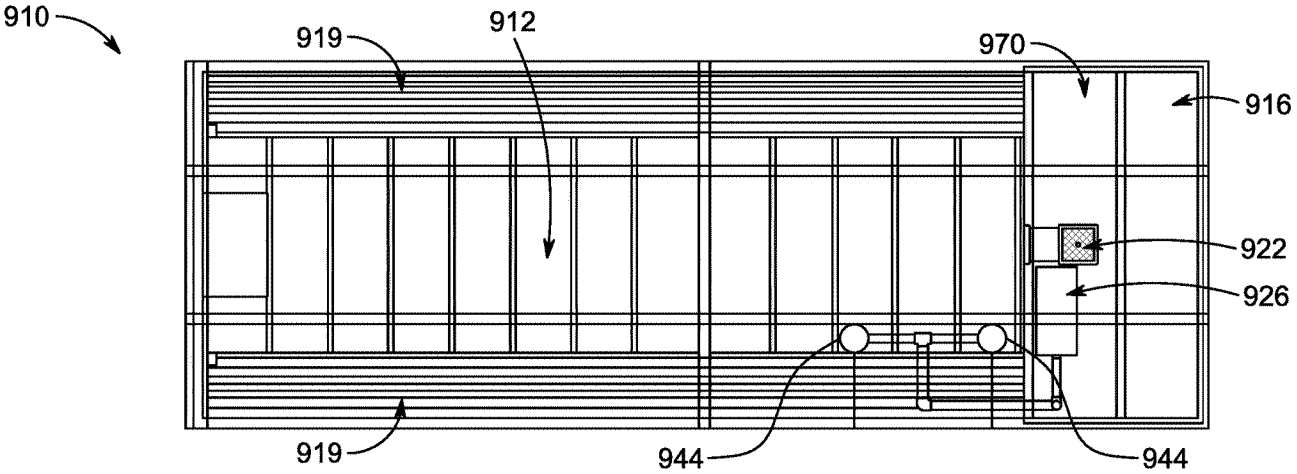
FIG. 9A provides an overhead view of a container including a swimming chamber according to one or more embodiments.

FIG. 9A provides an overhead view of a container 910 including a swimming chamber. Similarly to the diagram of FIG. 8A, the container 910 is illustrated as having a radiused bottom corner 919 of the swimming chamber 912 on side corners of the container. The overhead view of FIG. 9A shows a possible path of plumbing for plumbing lines 923 from the component housing 916 to drains 944 connected to an underside of the swimming chamber 912. Similarly to the plumbing of FIGS. 8A and 8B, the plumbing 923 of FIG. 9A may run along an underside of the container 910, or may fit at least partially within a cavity disposed between the radiused corner 919 and an exterior right-angle-corner of the container 910 on a bottom portion of the container. Although the container 910 is illustrated as having drains 944 in a particular position proximal to the pump 926 and component housing 916, it should be understood that the drains 944 may be positioned in any suitable or desirable position along the length or width of the container 910. The illustration of FIG. 9A further shows a skimmer component 922 which may receive water from the swimming chamber for filtration heating or other treatment of said water during operation of the pool container 910.

Figure 9B:
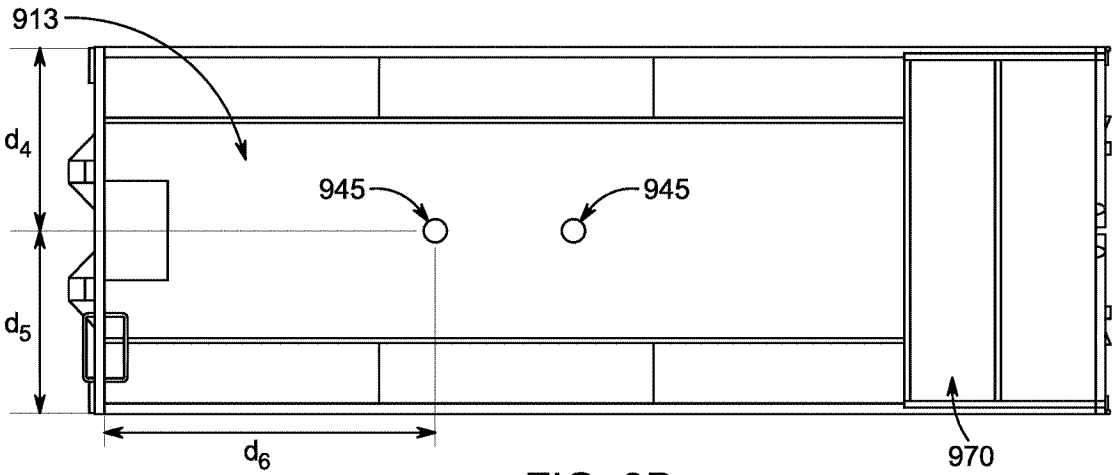
FIG. 9B provides yet another overhead view of a swimming container according to one or more embodiments.

FIG. 9B provides yet another overhead view of a swimming container having drain apertures 945, which may be disposed in a substantially central region of the swimming chamber 913. For example, the drains 945 may be disposed a distance $d_4$ laterally from a side portion of the container (e.g., a distance of approximately 2 feet) and a second distance $d_5$ (e.g., a distance of approximately 5 feet) from the opposite side of the container along a width of the container. The drains 945 may further be disposed a longitudinal distance $d_6$ from a front end of the container (e.g., a distance of approximately 9 feet). The illustrated container of FIG. 9B further includes a platform 970, which may be associated with a roof of a pool component housing chamber in certain embodiments.

The drains 945 may be spaced apart according to federal regulations for pool trains, or other specifications. The drains 945 of FIG. 9B show an alternative positioning for drains relative to the drains 944 shown in FIG. 9A.

Figure 10:
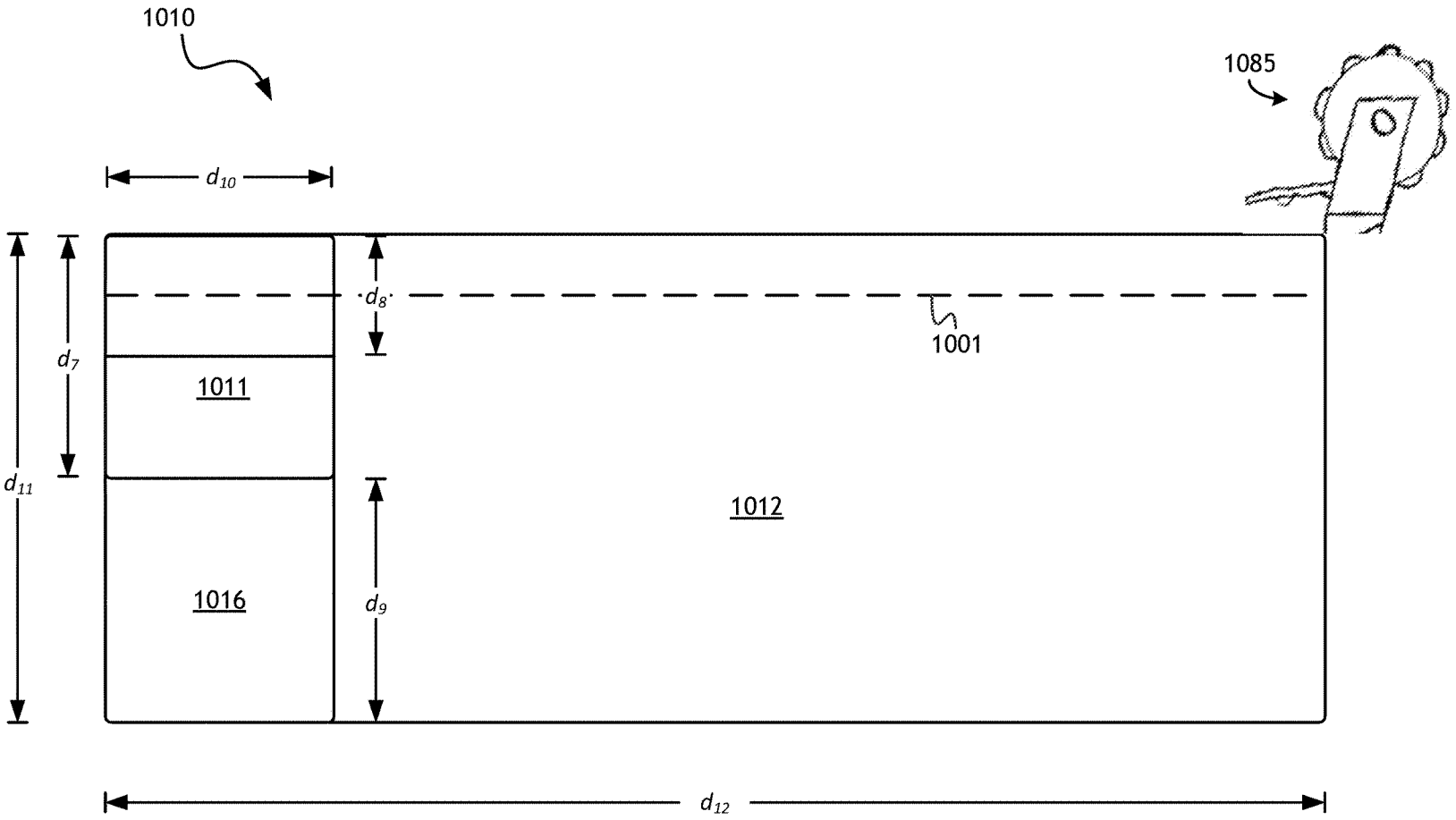
FIG. 10 illustrates a side view of a swimming container according to one or more embodiments

FIG. 10 illustrates a side view of a swimming container 1010 illustrating various dimensions of a swimming container according to certain embodiments disclosed herein. The container 1010 includes a swimming chamber 1012 and a pool components housing chamber 1016. The illustration of FIG. 10 further shows an example water line 1001, which may represent a height to which a volume of water may be advantageously filled in the swimming chamber 1012 of the container 1010. The diagram of FIG. 10 illustrates various alternative dimensional configurations of a container according to certain embodiments. For example, the swimming chamber 1012 the container 1010 may include a shallow end portion extending a longitudinal distance $d_{10}$ (e.g., a distance of approximately 4 feet), which may correspond to a longitudinal depth of the pool component housing chamber 1016. The vertical depth of the shallow end may be represented by one or more of the dimensions $d_8$, $d_7$, and may be, for example, approximately 2 feet in depth. In certain embodiments, the portion 1011 may comprise a hot tub portion of the container 1010, wherein the hot tub portion 1011 is partitioned physically from the swimming chamber 1012, such that water in the hot tub portion 1011 is at least partially prevented from flowing freely into the pool chamber 1012.

The collective vertical depth of the container 1010 is represented by the dimension $d_{11}$, and may have a value of approximately 6 feet in certain embodiments. The height $d_9$ of the pool component housing chamber 1016 and the depth of the shallow end portion of the pool chamber 1012 may combine to approximately the dimension $d_{11}$, which is the height of the container 1010, roughly. The container 1010 may have a total longitudinal length of approximately 22 feet, represented by the illustrated dimension $d_{12}$. The shallow end portion and/or pool component housing portion of the container 1010 may have a longitudinal dimension represented by the illustrated dimension $d_{10}$, which may be approximately 4 feet.

The container 1010 may further be associated with a pool cover component 1085 which may provide safety and/or protection from debris or serve other purposes, such as pool heating or the like. In certain embodiments, the pool container 1010 includes a deck portion (not shown), wherein the pool cover may be housed or contained at least partially within a portion of the deck, such as during non-use of the pool cover. Additionally or alternatively, one or more mechanical and/or electrical components associated with the cover 1085 may be housed within the deck portion or other portion of the container 1010, and may provide for automatic and/or manual winding up of the pool cover, or other pool-cover-related functionality.

Figure 11:
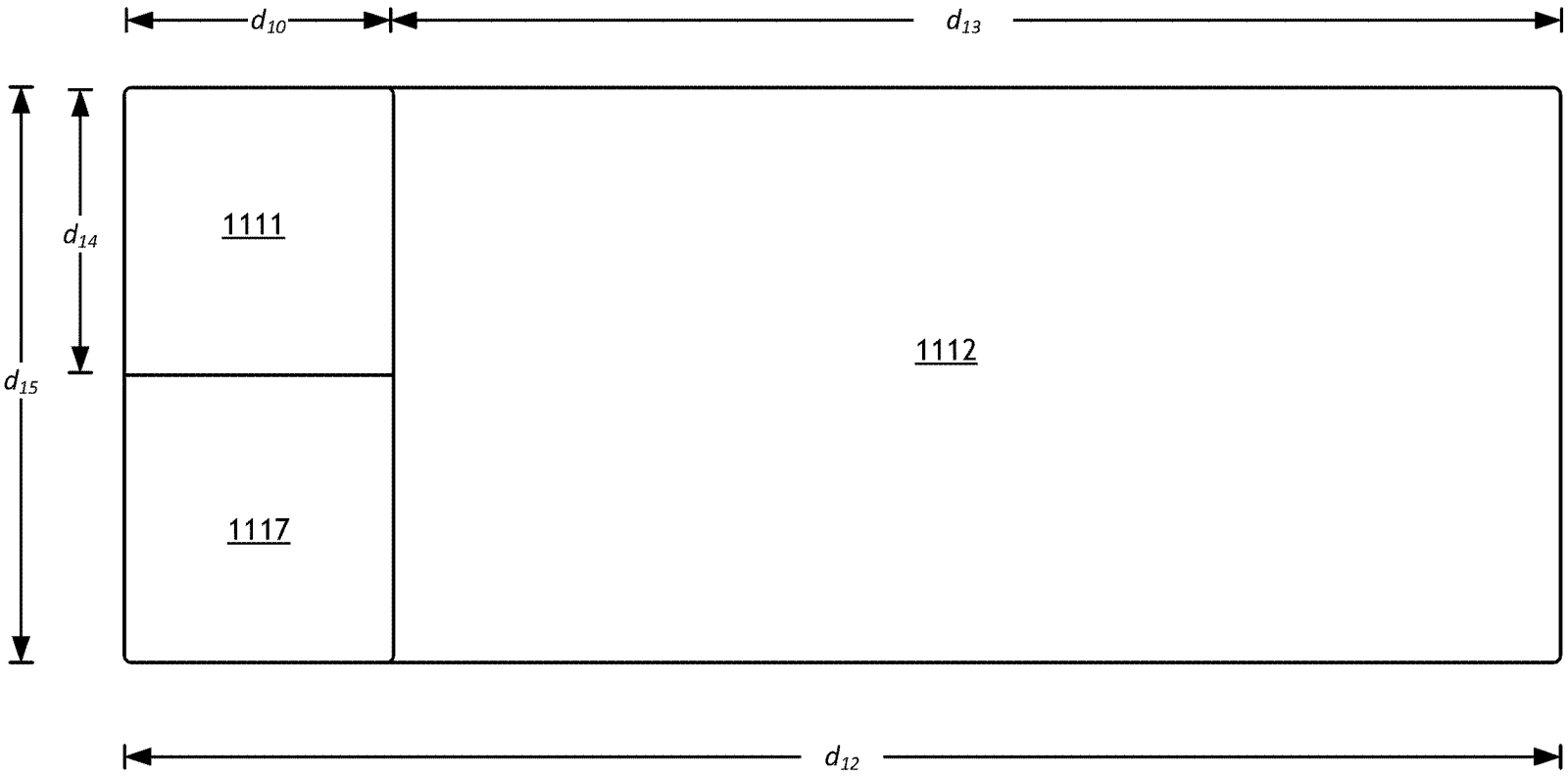
FIG. 11 illustrates a top-down view of a pool container according to one or more embodiments.

FIG. 11 illustrates a top-down view of a pool container 1110 according to one or more embodiments. The pool chamber 1110 includes a longitudinal dimension $d_{12}$, which may be approximately 4 feet. That pool container 1110 further illustrates a primary swimming chamber 1112, as well as a plurality of secondary regions or chambers 1111, 1117. In certain embodiments, one of the plurality of secondary chambers or regions 1111, 1117 comprises a shallow end portion, wherein said portion holds water that is allowed to substantially freely flow between the main portion 112 and the secondary shallow end portion. Another of the secondary chambers or regions 1111, 1117 may comprise a hot tub portion, which may be at least partially partitioned and/or segregated from the remaining regions or chambers of the container 1110.

Collectively, the secondary chambers or portions 1111, 1117 may have a combined with of approximately 8 feet, represented by the dimension $d_{15}$ shown. In certain embodiments, each of the secondary chambers or regions has a uniform width $d_{14}$, which may represent half of the dimension $d_{15}$ shown. Alternatively, the dimension $d_{14}$, corresponding to the width of one of the secondary chambers or regions of the container 1110 may have a value that is greater than a corresponding with dimension of the other of the chambers or portions 1111, 1117.

Furthermore, one or more of the secondary chambers or portions 1111, 1117 may comprise a longitudinal depth represented by the illustrated dimension $d_{10}$, which may have a value of approximately 4 feet. In certain embodiments, the main pool chamber 1112 may have a longitudinal dimension of approximately 18 feet, represented by the dimension $d_{13}$ illustrated, which, combined with the dimension $d_{10}$, may add up to the total longitudinal dimension $d_{12}$ of the container 1110.

Figure 12:
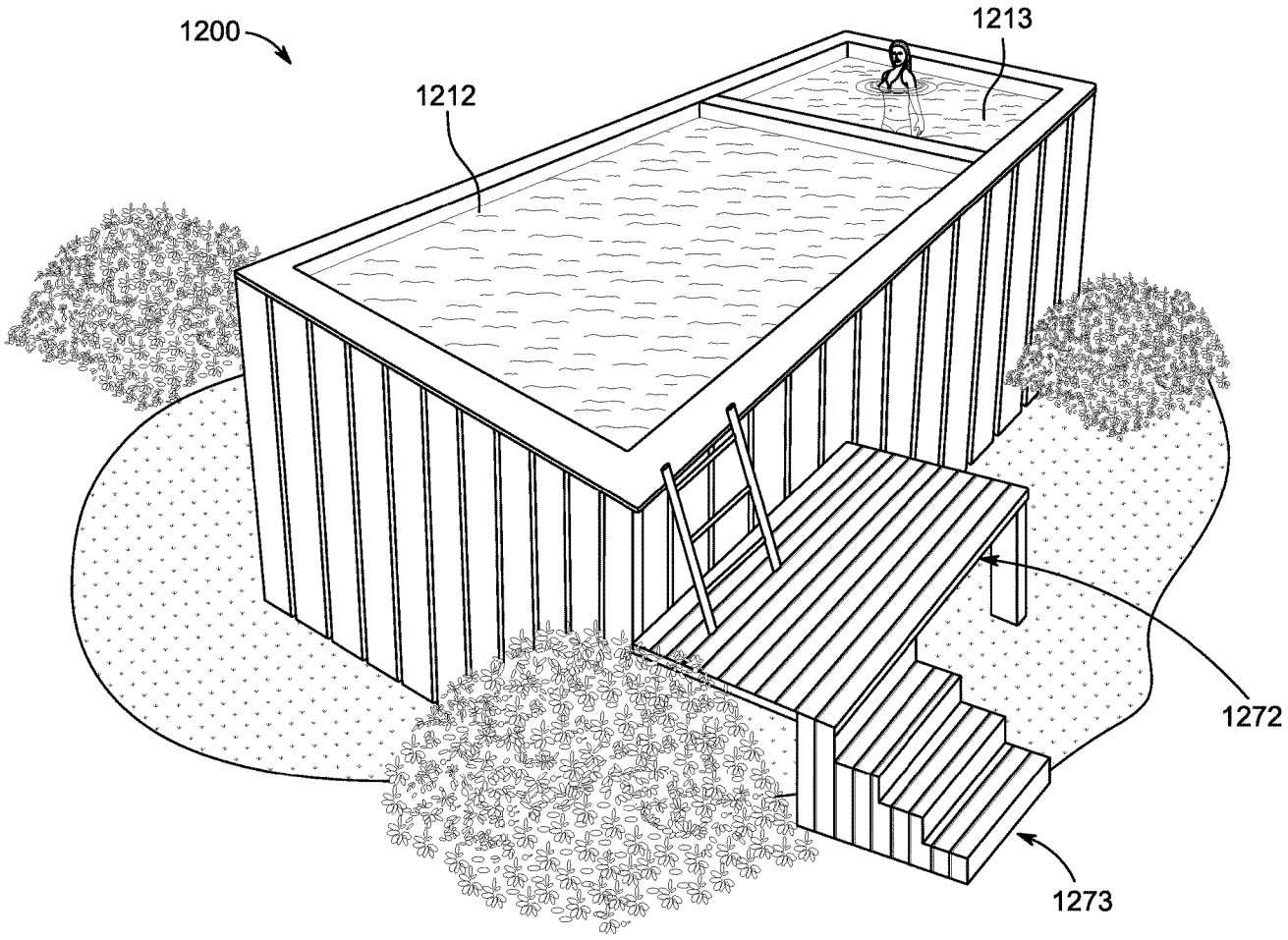
FIG. 12 illustrates a perspective view of a swimming container according to one or more embodiments.

FIG. 12 illustrates a perspective view of a swimming container 1200 having a main swimming chamber 1212, as well as a secondary swimming chamber 1213, which may be a hot tub feature or the like. The swimming container 1200 further includes an exterior platform 1272, which may have associated with therewith one or more stairs 1273. The platform 1272 may be substantially non-portable platform structure, which may be integrated with the swimming container 1200, or otherwise associated therewith. The deck 1272 may have any desirable height, and may further include a ladder that leads from the deck structure 1272 to one or more swimming chambers of the container 1200.

Figure 13:
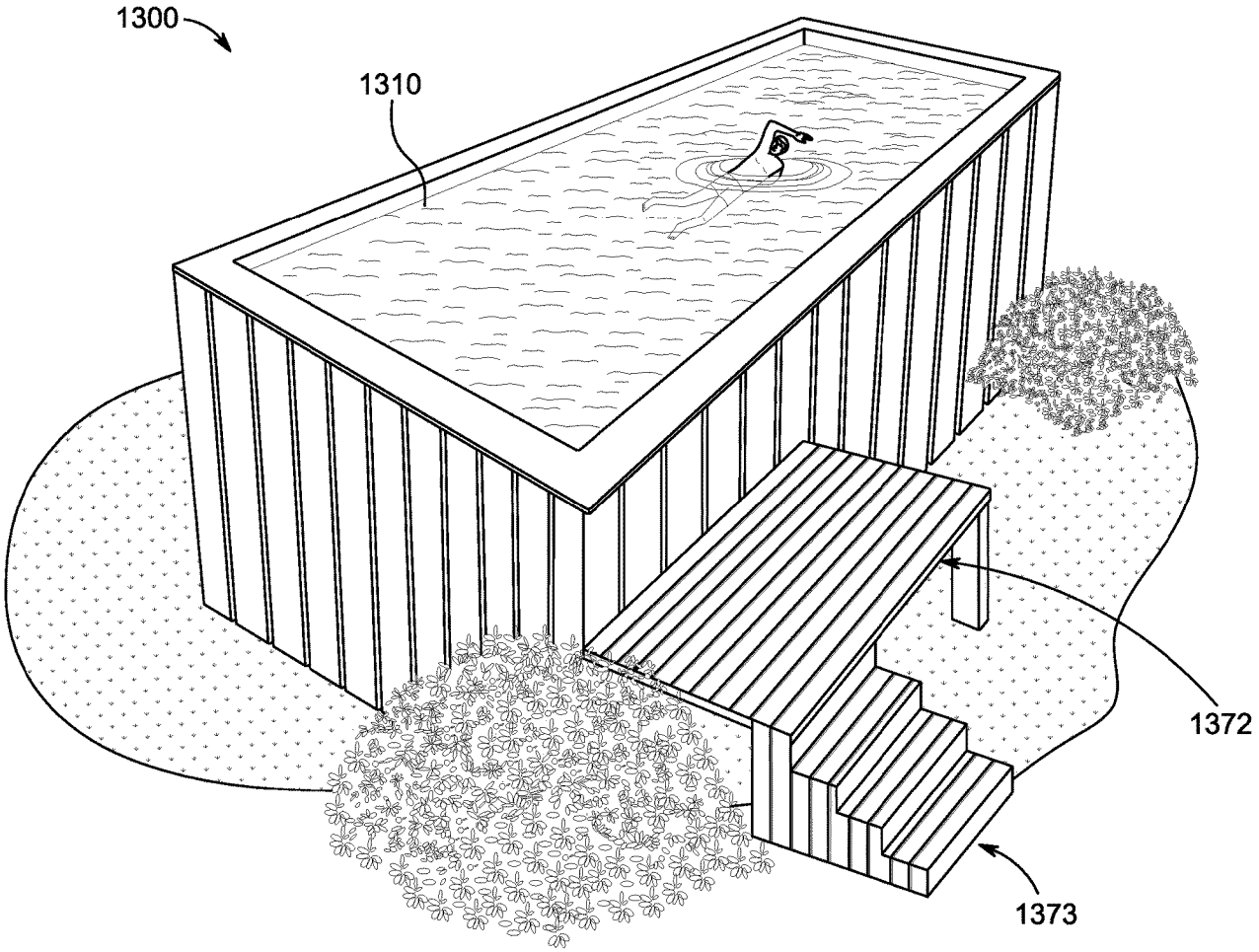
FIG. 13 illustrates a perspective view of a swimming container according to one or more embodiments.

FIG. 13 illustrates a perspective view of the swimming container 1300 including a singular main swimming chamber 1310 that extends substantially the entire longitudinal length of the pool container 1300. In certain embodiments, the swimming container 1300 may be used as a lap pool. The pool components associated with the swimming container 1300 may be maintained in a bottom chamber (not shown) positioned or disposed at least partially beneath the primary swimming chamber 1310, or may be maintained in an exterior housing structure (not shown) coupled or associated with the pool container 1300 in some manner.

Figure 14:
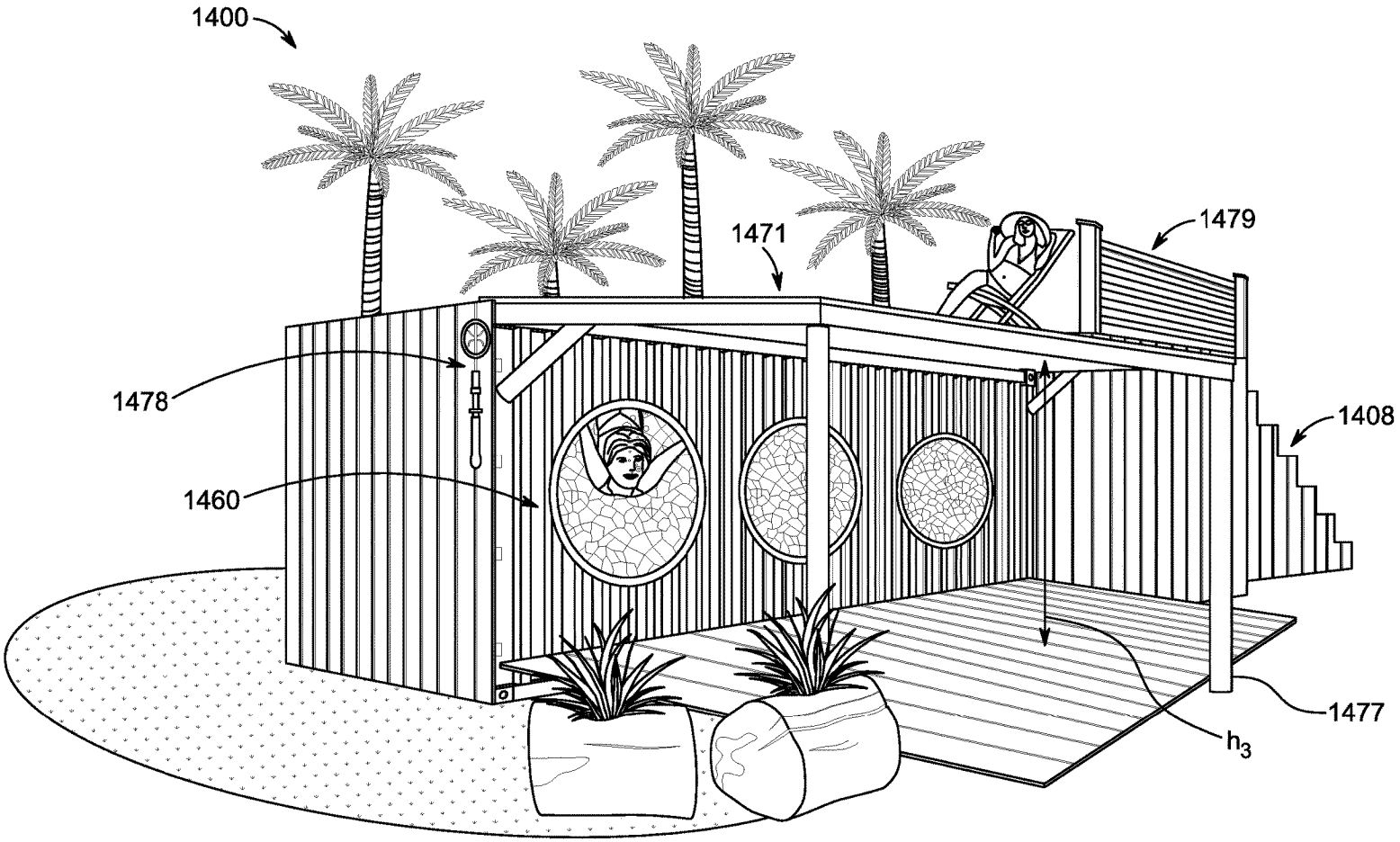
FIG. 14 illustrates a pool container having a pop-up deck feature according to one or more embodiments

FIG. 14 illustrates a pool container 1400 having a pop-up deck feature 1471, which may be a substantially retractable deck having one or more support structures or posts 1477. The swimming container 1500 may be configurable such that the deck may be extended upward from a closed position wherein the deck 1471 lies substantially flush with a side portion of the swimming container 1400 when in the closed state. When extended outward and upward, the support members 1477 may be used to provide support for the deck in a horizontal position as shown. One or more windows 1460 may be revealed under the deck portion 1471 when the deck portion 1471 is opened from a closed position.

The opening of the deck portion 1471 may be facilitated by a crank or other feature 1478, which may provide for manual and/or at least partially automatic extension of the deck portion 1471. The retractable deck 1471 may be supported by pulling the beams 1477 down and allowing the deck to rest upon the beams which are supported by the ground or other surface. The retractable characteristics of the deck 1471 may allow for greater mobility of the swimming container 1400, wherein the swimming container 1400 may be transported or repositioned while the deck 1471 is in a substantially closed state.

One or more barrier or rail members 1479 may be disposed to provide safety and/or aesthetic features for the deck 1471. For example, a rail or fence structure may be positioned substantially around the perimeter/periphery of the deck 1471. The banister feature may be integrated with the deck or mountable thereto. For example, the banister feature may comprise one or more holes and/or pull features that connect into the deck to secure thereto. The banister feature may have any desirable height, such as 4 feet, 6 feet, or other height.

Figure 15:
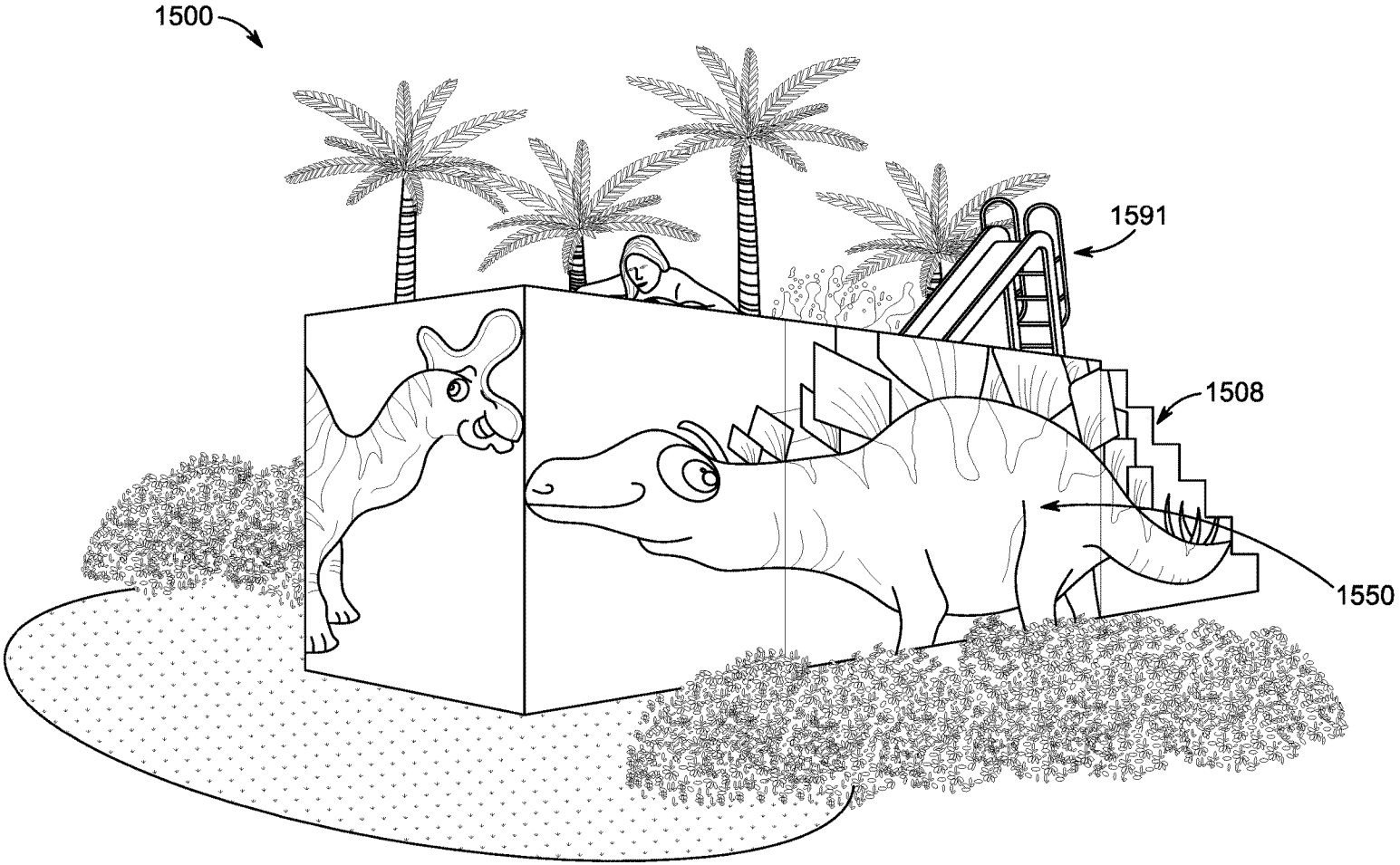
FIG. 15 illustrates a swimming container according to one or more embodiments.

FIG. 15 illustrates a swimming container 1500 including an additional slide features 1591 which may be integrated with the swimming container 1500 or attachable or disposable thereon. The swimming container 1500 may be further associated with one or more step features 1508 which may be integrated with the swimming container, or otherwise associatable therewith.

In certain embodiments, the swimming container 1500 may comprise an exterior paneling 1550, which may be, for example, print-on wood or other material. The exterior paneling 1550 may be preprinted with certain designs and/or features to provide aesthetic features and/or customizability of the swimming container 1500. The paneling may be configured to be bolted or otherwise connected to an exterior of the swimming container 1500, such as by a French cleat, snap connector, or other removable connection mechanism. In certain embodiments, different paneling options may be interchangeable, such that the appearance of the swimming container 1500 may at least partially be modifiable by a user.

Figure 16:
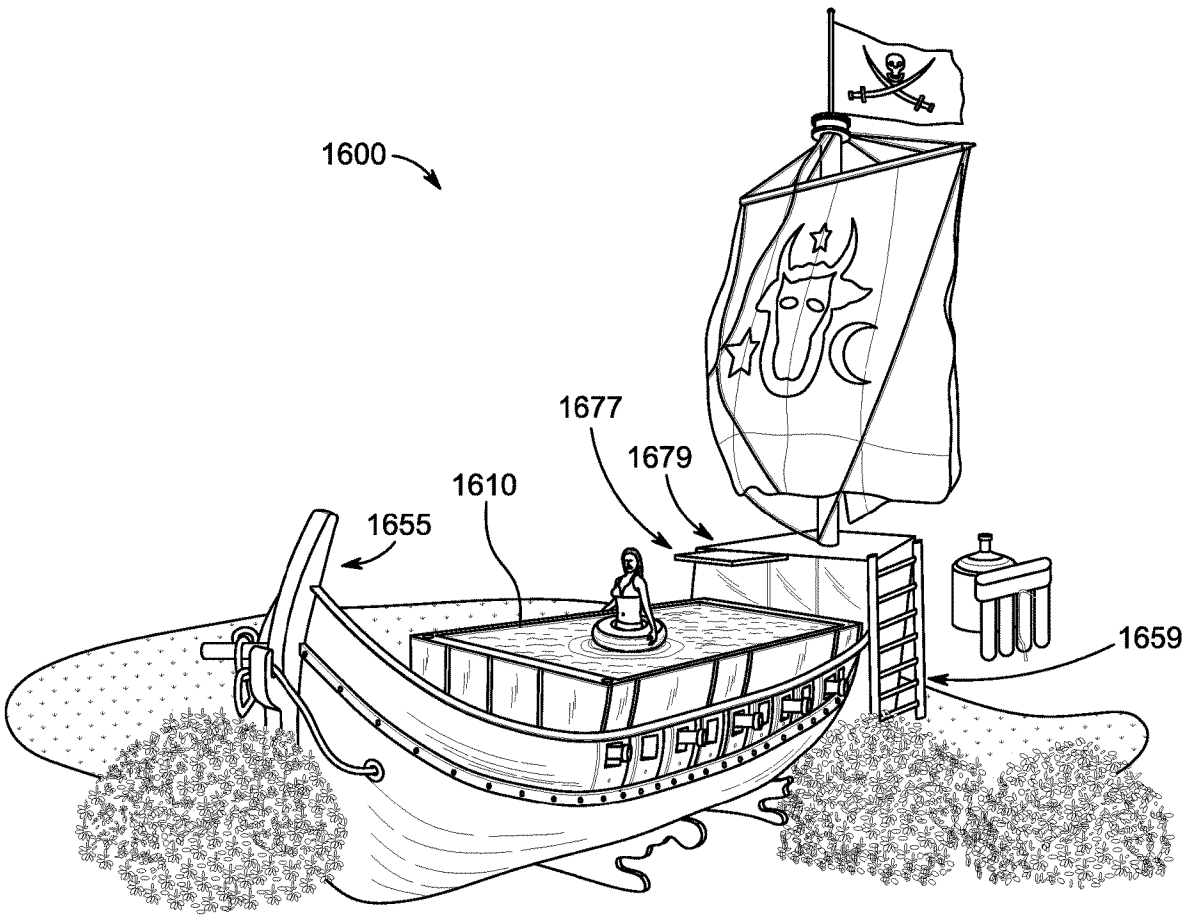
FIG. 16 illustrates swimming container according to one or more embodiments.

FIG. 16 illustrates swimming container 1600 having an enhanced exterior feature 1755, which may be a structure configured to surround at least partially an interior swimming container 1610 and provide aesthetic and/or structural features for the container 1600.

The swimming container 1600 may further include a platform structure 1679 having one or more additional features associated therewith, such as a diving board 1677 and/or ladder 1659. In certain embodiments, the platform structure 1679 is configured to house one or more pool components, in a similar manner as described above in connection with other embodiments. The exterior structure 1655 may take any form or shape as desirable, such as the illustrated pirate ship structure or other form.

Figure 17:
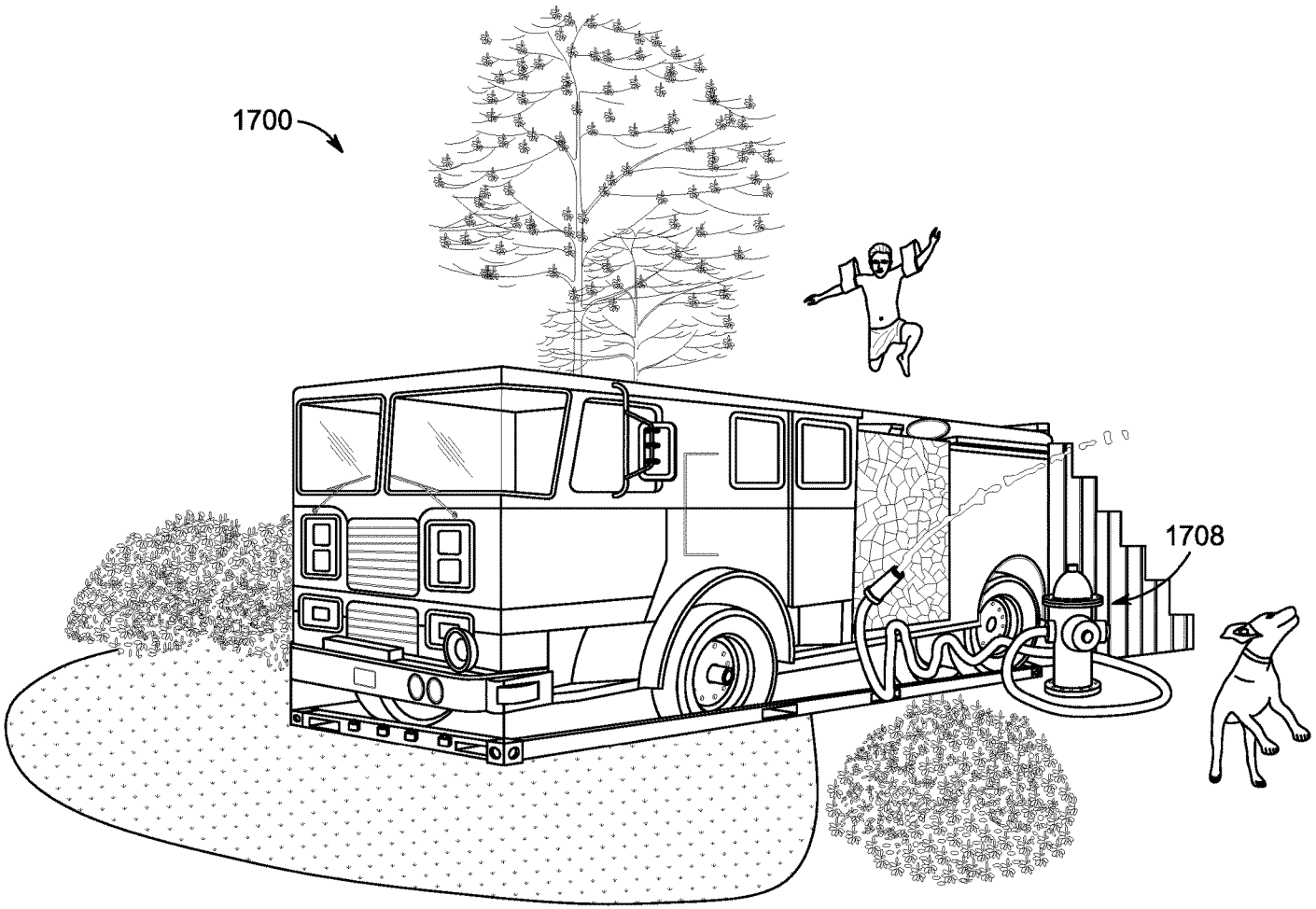
FIG. 17 illustrates a perspective view of a swimming container according to one or more embodiments.

FIG. 17 illustrates a perspective view of a swimming container 1700 having a themed design, for example, a fire truck design or the like. A design of a pool container 1700 may include one or more additional features, such as a water pump may be used to circulate water from the pool for entertainment or other purposes. The water pump 1708 may include a hose, and may be positioned exterior to the swimming container 1700, and/or may be disposed on a top deck portion or other portion of the swimming container 1700. The water pump 1708 may be configured to receive water from in-ground plumbing, or the pool itself.

Other Embodiments

Unless the context clearly requires otherwise, throughout the description and the claims, the words "comprise," "comprising," and the like are to be construed in an inclusive sense, as opposed to an exclusive or exhaustive sense; that is to say, in the sense of "including, but not limited to." The word "coupled", as generally used herein, refers to two or more elements that may be either directly connected, or connected by way of one or more intermediate elements. Additionally, the words "herein," "above," "below," and words of similar import, when used in this application, shall refer to this application as a whole and not to any particular portions of this application. Where the context permits, words in the above Description using the singular or plural number may also include the plural or singular number respectively. The word "or" in reference to a list of two or more items, that word covers all of the following interpretations of the word: any of the items in the list, all of the items in the list, and any combination of the items in the list.

The above detailed description of embodiments of the invention is not intended to be exhaustive or to limit the invention to the precise form disclosed above. While specific embodiments of, and examples for, the invention are described above for illustrative purposes, various equivalent modifications are possible within the scope of the invention, as those skilled in the relevant art will recognize. For example, while processes or blocks are presented in a given order, alternative embodiments may perform routines having steps, or employ systems having blocks, in a different order, and some processes or blocks may be deleted, moved, added, subdivided, combined, and/or modified. Each of these processes or blocks may be implemented in a variety of different ways. Also, while processes or blocks are at times shown as being performed in series, these processes or blocks may instead be performed in parallel, or may be performed at different times.

Similarly, it should be appreciated that in the above description of embodiments, various features are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that any claim require more features than are expressly recited in that claim. Rather, inventive aspects lie in a combination of fewer than all features of any single foregoing disclosed embodiment.

The teachings of the invention provided herein can be applied to other systems and assemblies, not necessarily the systems/assemblies described above. The elements and acts of the various embodiments described above can be combined to provide further embodiments.

While some embodiments of the inventions have been described, these embodiments have been presented by way of example only, and are not intended to limit the scope of the disclosure. Indeed, the novel methods and systems described herein may be embodied in a variety of other forms; furthermore, various omissions, substitutions and changes in the form of the methods and systems described herein may be made without departing from the spirit of the disclosure. The accompanying claims and their equivalents are intended to cover such forms or modifications as would fall within the scope and spirit of the disclosure.

What is claimed is:

1. A swimming container comprising:

a first compartment at a first longitudinal end of the swimming container having a roof structure forming at least part of a deck structure, the first compartment having first and second doors providing access to the first compartment;

a water pump housed within the first compartment;

a water filter device housed within the first compartment;

first and second sidewalls extending along a length of the swimming container;

a wall partition connected between the first and second sidewalls at a position along the length of the swimming container, the wall partition providing water-tight separation between the first compartment and a second compartment configured to hold a volume of water;

a bottom portion comprising:

one or more drain apertures;

a guide track that runs along a longitudinal center of the bottom portion;

first and second wheels disposed on opposite sides of the guide track at a second longitudinal end of the swimming container; and a hook structure disposed at the second longitudinal end of the swimming container at least partially above the guide track; and a support beam extending vertically along each of the first and second sidewalls and below the bottom portion to provide support for the swimming container;

wherein the support beam is integrated with a window frame of the first sidewall.

2. The swimming container of claim 1, wherein at least one of the first and second doors comprises a vent aperture.

3. The swimming container of claim 1, further comprising a pipe running beneath the bottom portion and connecting the one or more drain apertures to the water pump in the first compartment.

4. The swimming container of claim 1, wherein the first sidewall includes a window comprising a rigid, transparent panel structure.

5. The swimming container of claim 1, wherein the deck structure provides an ingress/egress platform for the second compartment.

6. The swimming container of claim 1, further comprising one or more removable exterior panels secured to one or more of the first and second sidewalls.

7. The swimming container of claim 1, wherein the bottom portion further comprises support members at each of four corners of the swimming container.

8. The swimming container of claim 7, wherein the support members comprise two wheel supports and two foot supports.

9. A swimming container comprising:

a first compartment at a first longitudinal end of the swimming container having a roof structure forming at least part of a deck structure, the first compartment having first and second doors providing access to the first compartment, the first compartment being dimensioned to house:

a water pump; and a water filter device;

first and second sidewalls extending along a length of the swimming container;

a wall partition connected between the first and second sidewalls at a position along the length of the swimming container, the wall partition providing water-tight separation between the first compartment and a second compartment configured to hold a volume of water;

a bottom portion comprising:

one or more drain apertures;

a guide track that runs along a longitudinal center of the bottom portion;

first and second wheels disposed on opposite sides of the guide track at a second longitudinal end of the swimming container; and a hook structure disposed at the second longitudinal end of the swimming container at least partially above the guide track; and a rectangular upper frame at least partially lining an upper perimeter of the second compartment, the upper frame including a receptacle configured to removably receive a connection portion of a recessed platform structure.

10. The swimming container of claim 9, wherein the recessed platform structure forms a shallow-end standing surface for the second compartment when secured to the upper frame.

11. The swimming container of claim 9, wherein the recessed platform structure forms a seat disposed within the second compartment when secured to the upper frame.

12. The swimming container of claim 1, further comprising a radiused floor surface forming a longitudinal cavity between the radiused floor surface and the bottom portion.

13. The swimming container of claim 12, comprising a pipe disposed within the longitudinal cavity that is connected to the water filter device.

14. A method of manufacturing a swimming container, the method comprising:

providing an open-top container having a rectangular prism shape, the open-top container including:

a front end wall;

first and second sidewalls;

a back end wall formed of first and second doors; and a bottom structure comprising a guide track that runs along a longitudinal center of the bottom structure, first and second wheels secured on opposite sides of the guide track, and a hook structure disposed proximate the front end wall at least partially above the guide track, the front end wall, the first and second sidewalls, the back end wall, and the bottom structure forming a trench;

dividing the trench into a first compartment and a second compartment at least in part by attaching a wall partition to the first and second sidewalls in a substantially water-tight attachment;

forming a deck structure at least in part by attaching a roof structure to the first and second sidewalls, the back end wall, and the wall partition at least partially above the first compartment;

disposing a water pump and a water filter within the first compartment;

forming an aperture in the second compartment; and connecting the water pump to the aperture.

15. The method of claim 14, further comprising cutting a vent aperture in the first door.

16. The method of claim 14, further comprising forming a receptacle in an upper frame that lines at least part of the second compartment, the receptacle being configured to removably receive a connection portion of a recessed platform structure.

17. The method of claim 16, wherein the recessed platform structure forms a shallow-end standing surface for the second compartment when secured to the upper frame.

18. The method of claim 16, wherein the recessed platform structure forms a seat disposed within the second compartment when secured to the upper frame.

* * * * *